US007284791B1

(12) United States Patent
Wright

(10) Patent No.: US 7,284,791 B1
(45) Date of Patent: Oct. 23, 2007

(54) REMOTE CONTROL INNOVATOR

(75) Inventor: Tommy Dale Wright, 1808 W. Helen, North Las Vegas, NV (US) 89032

(73) Assignee: Tommy Dale Wright, N. Las Vegas, NV (US)

( * ) Notice: Subject to any disclaimer, the term of this patent is extended or adjusted under 35 U.S.C. 154(b) by 123 days.

(21) Appl. No.: 11/008,541

(22) Filed: Dec. 9, 2004

Related U.S. Application Data

(60) Provisional application No. 60/527,720, filed on Dec. 9, 2003.

(51) Int. Cl.
*A47C 7/62* (2006.01)

(52) U.S. Cl. ..... 297/188.18; 206/320; 211/26.1

(58) Field of Classification Search ..... 297/188.18, 297/188.2; 248/311.2, 364, 694; 211/26.1; 206/320; 383/38, 39
See application file for complete search history.

(56) References Cited

U.S. PATENT DOCUMENTS 1,725,508 A * 8/1929 Bell-Clifford ..... 297/188.18
2,061,302 A * 11/1936 Egler ..... 297/188.18
4,848,609 A 7/1989 Meghnot
4,893,222 A * 1/1990 Mintzer ..... 248/172
5,042,670 A 8/1991 Timberlake
D324,810 S 3/1992 Moye, Sr.
5,127,615 A * 7/1992 Jones ..... 248/172
D333,580 S 3/1993 Brummett
D346,085 S * 4/1994 Wagner ..... D6/513
D364,058 S 11/1995 Wilk
D377,876 S 2/1997 Hatala
5,605,235 A 2/1997 Johnson
5,692,608 A 12/1997 Simien
5,872,702 A 2/1999 Kopel

* cited by examiner

*Primary Examiner*—Peter R. Brown

(57) ABSTRACT

A remote control holding device that rests on the arm of a recliner, chair, sofa, loveseat or the like with a slot for a remote control. The holder preferably will have at least one extra pouch for a further remote control and one for magazines, snacks, newspapers and the like. The holder is adjustable to allow for different size furniture and also different size remote controls through a sliding track mechanism and is also preferably higher at the front end than the matching rear end. Differing amounts of pouches can be attached depending on requirements. A remote control rest can be turned through 180 degrees to accommodate left and right handed users.

10 Claims, 6 Drawing Sheets

REMOTE CONTROL INNOVATOR

CROSS REFERENCE TO RELATED APPLICATIONS

I hereby claim benefit under Title 25, United States Code, Section 119 (e) of U.S. provisional patent application Ser. No. 60/527,720 on Dec. 9, 2003. The application 60/527,720 is hereby incorporated by reference into this application.

FIELD OF THE INVENTION

The present invention relates to a remote control innovator which from hereon in will be referred to as a remote control holder. The unique design of the holder means that a user never need loose a remote again. The holder has a strap to hold the remote in a secure position to allow hands free channel searching.

A pouch or pouches on the holder provides a user with convenient storage for additional remote controls. These pouches also allow for the storage of favourite magazines, newspapers, snacks or the like.

The versatile design of the holder allows a user to sit on a sofa, loveseat or recliner and have all his or her remotes easily accessible. The holder also allows for easy positioning for left or right handed users.

DESCRIPTION OF PRIOR ART

Examples of prior art masking tape are described below:

U.S. Pat. No. 5,692,608 (SIMIEN, CYNTHIA (US)) discloses a remote control caddy which is detachably affixed to a sofa or chair and has one or more pockets for the placement and storage of remote control devices, such as TV or stereo remote control units. The remote control caddy is made of upholstery fabric, lined with an upholstery fabric liner, which preferably matches the fabric of the sofa or chair to which it is affixed.

U.S. Pat. No. 5,605,235 (JOHNSON, RHONDA D. (US)) discloses a holder for a plurality of remote control devices for controlling audiovisual equipment. The holder has an upwardly open pocket sufficiently wide to hold at least two controllers abreast. A planar support arm extends upwardly from the pocket, and includes a horizontal extension. The horizontal extension is inserted below the cushion of a cushioned chair or sofa, or below the mattress of a bed. The holder is readily installed in and removed from the furniture. The holder engages the furniture without penetration thereof, alteration thereof, or permanent attachment thereto. The holder is thus conveniently, unobtrusively, accessibly, and visibly stored close at hand, without occupying horizontal table space or requiring a separate piece of furniture for secure storage.

U.S. Pat. No. 5,872,702 (KOPEL, PHILIP S. (US)) discloses a remote control holder having a mounting face to which several remote control units are attached using releasable fastening strips. The mounting face terminates in a curved frontal section enabling the holder to be hung on a television or other piece of furniture when not in use. A label containing information, such as a channel guide, is attached to the mounting section undersurface. A clear acrylic window fits over the label and attaches flush onto the undersurface providing protection for the label.

U.S. Pat. No. 5,042,670 (TIMBERLAKE, BONNIE F. (US)) discloses a rack structure constructed to support a TV remote controller, a VCR remote controller, a television program listing booklet, and a plurality of VCR cartridges.

The rack structure can be positioned near a chair or couch occupied by a person while viewing a television receiver. Either controller can be operated by the person without removing the controller from the rack structure. Also, the person can read information from the television program booklet to select the program he wishes to turn on with the TV controller.

U.S. Pat. No. 4,848,609 (MEGHNOT, RUPERT L. A. (US)) discloses an adjustable device for holding together any two remote television (TV), stereo and videocassette recorder (VCR) monitor control units. The device consists of two interconnecting pieces having sides with gripping means for firmly holding the monitors in place, bottom portions which interconnect by tongue and groove means and upper portions having matching teeth and grooves for adjustably interconnecting the two pieces to hold any two sizes of controls. The device can be easily held in one hand, thereby leaving the other hand free to operate the TV, stereo and VCR remote control units at the same time. This device prevents remote control units from being misplaced and protects said units from damage due to dropping Reference is also made to the following U.S. Design Pat. Nos. D333580 (Brumett; Beatrice L. issue date Mar. 2, 1993), D324810 (Moye, Sr, Marvin T. issue date Mar. 24, 1992), D436085 (Wagner; John P issue date Apr. 19, 1994), D364058 (Wilk, Philip A. issue date Nov. 14, 1995) and D377876 (Hatal, John P.; Hatala Andrew A. issue date Feb. 11, 1997) which all show remote control holders available in the prior art.

The remote control holder according to the present invention substantially departs from the conventional concepts and designs of the prior art, and in doing so provides a holder that overcomes the shortcomings of prior art devices. Therefore the present invention substantially fulfils this need.

SUMMARY OF THE INVENTION

A primary object of the invention is to provide a remote control holder that rests on the arm of a recliner, chair, sofa, loveseat or the like with a slot for a remote control. The holder preferably will have at least one extra pouch for a further remote control and one for magazines, snacks, newspapers and the like.

Another object of the invention is to provide a remote control holder that does not need the remote control to be picked up to be used.

Another object of the invention is to provide a remote control holding device that does not require the use of screws.

Another object of the invention is to provide a remote control holding device that can hold any size remote control with the use of internal tracks.

Another object of the invention is to provide a remote control holder that can hold any size remote control.

Another object of the invention is to provide the availability in one remote control holder of several remote controls in a central location on the arm of a sofa, chair, loveseat or the like.

Another object of the invention is to provide a remote control holder that has a sliding adjustment with a resting stop.

Another object of the invention is to provide walls on the remote control holder to retain a remote control and hold it in place in a resting position.

Another object of the invention is to provide a remote control holder that uses releasable fastening means to attach additional storage pouches to hold additional remote controls, magazines, books, snacks and the like.

Another object of the invention is to provide a remote control holder having a weighted end to provide an anchor to hold the holder in place.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Figure 4:
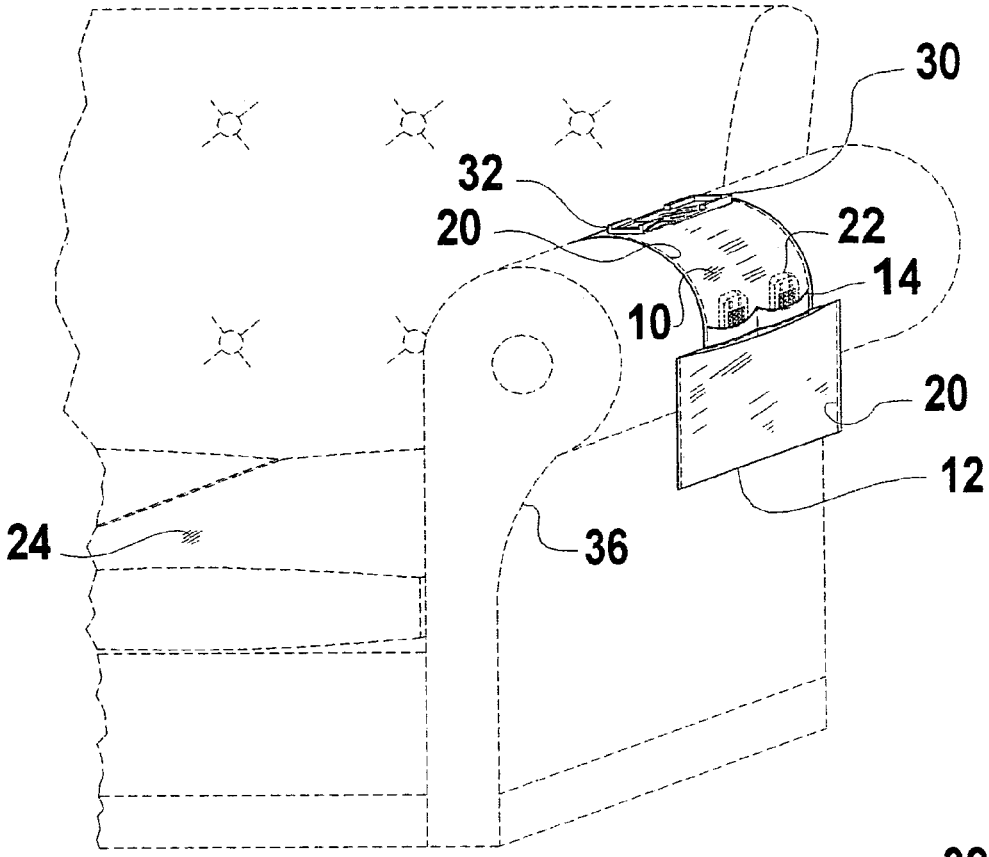
FIG. 4 shows an isometric view of the remote control holder of the present invention in use
Figure 5:
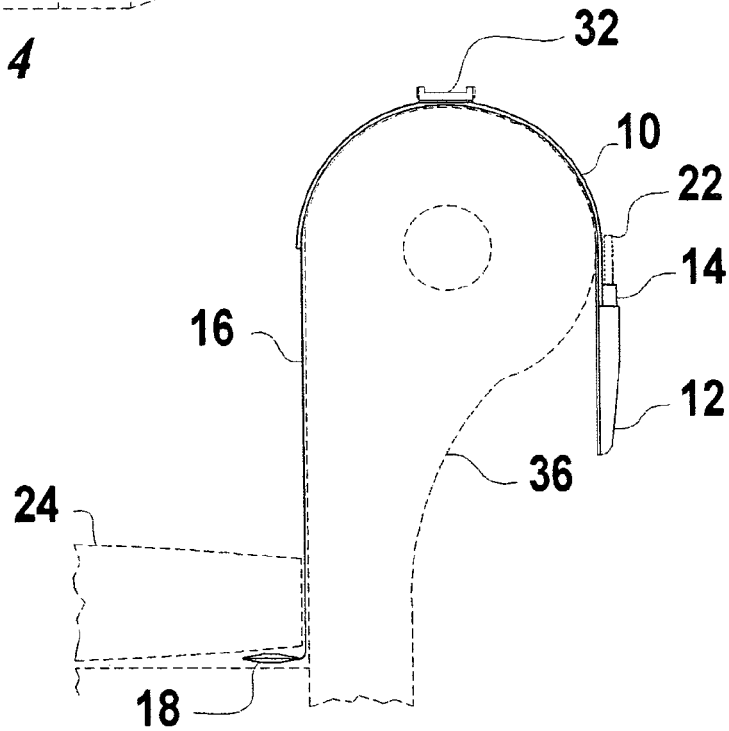
FIG. 5 shows a side view of the remote control holder of the present invention in place over the arm of a chair
Figure 6:
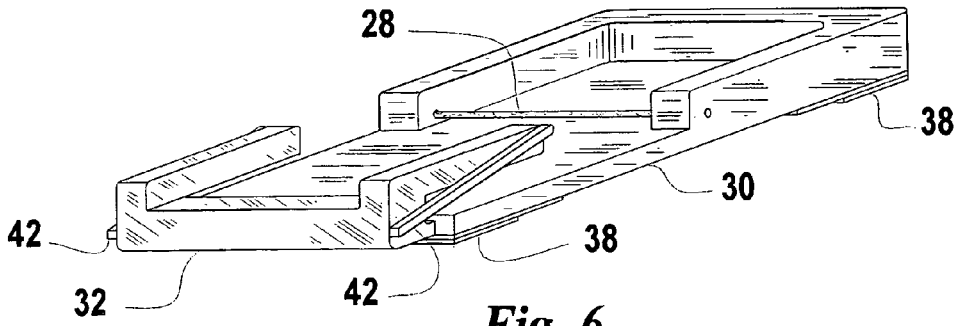
FIG. 6 shows an isometric view of the remote control holder of the present invention mounting device in a non-extended position

A view of the remote control holder of the present invention in use is shown in FIG. 4 on the arm (36) of a chair, loveseat or the like. At one end of the holder is a magazine or snack holder (12) which is stitched around its edge with stitching (20). A middle connection strip (10) is attached to the magazine and snack holder (12). Additional remote control pouches (14) are provided on the middle connection strip (10) to hold additional remote controls (22). A remote control rest (30) and (32) is shown in the middle part of the holder to hold a remote control (not shown). The rest has side wall braces (42). The holder is held in place under a cushion (24) on the chair. This is best shown in FIG. 5. The middle connection strip (10) is connected, at its other end to the snack holder (12), to an anchor strap (16) having at its distal end an anchor (18). The anchor is preferably weighted with sand or other suitable weighting material that goes under the cushion (24) that a user sits on to provide stability on an arm of the chair. The anchor can be made of any suitable materials but will need to be strong enough to hold the weighting material such as a vinyl type material. The one side of the anchor, for example the underside of the anchor in use, should preferably have a fastening material on it to hold it in place on the chair.

Figure 1:
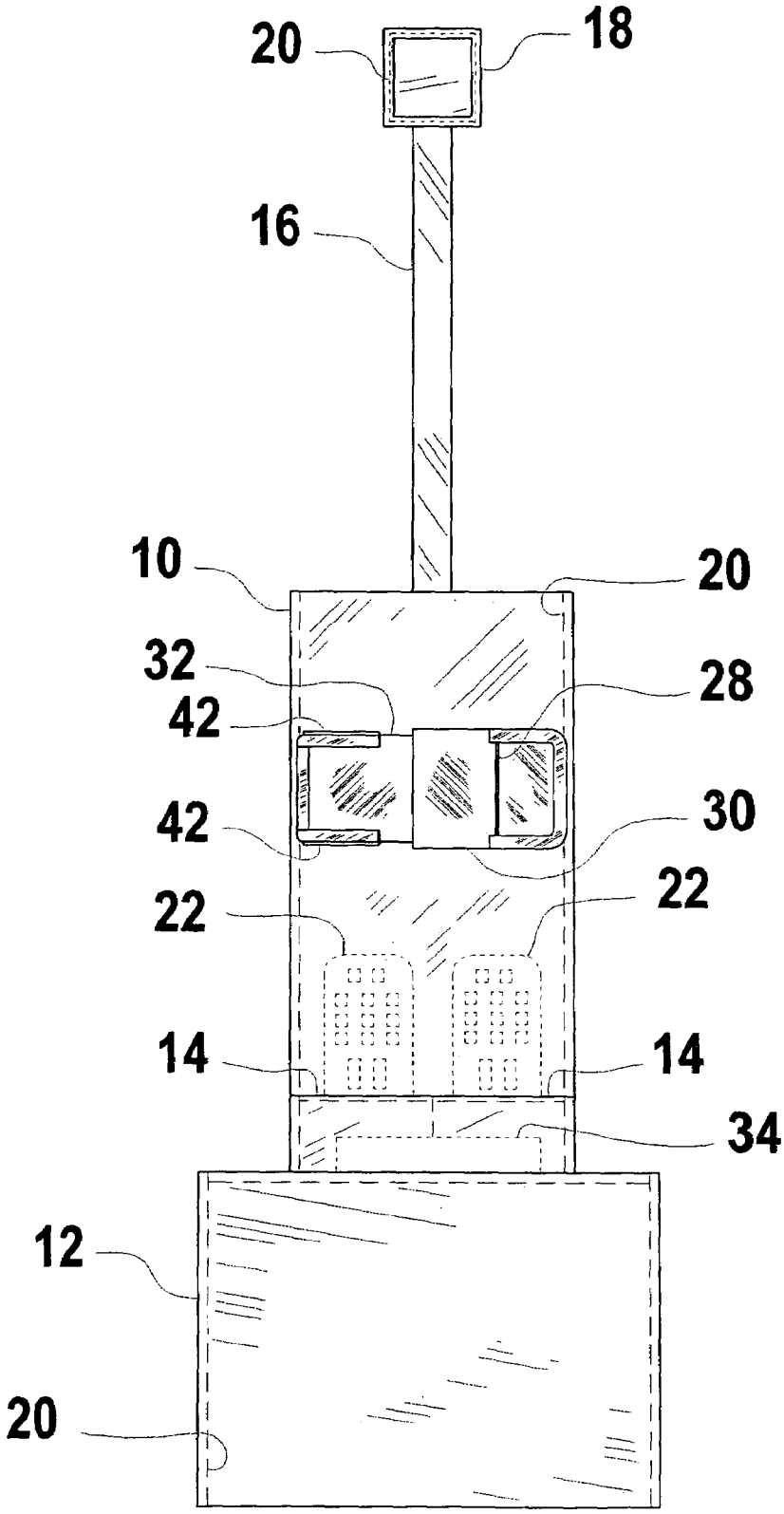
FIG. 1 shows a front view of the remote control holder of the present invention

Returning to FIG. 1 a front view of the remote control holder is shown showing the magazine or snack holder (12) connected to a book holder (34), having remote control holders (14) in which sits remote controls (22), which is attached to a middle connection strip (10). To this connection strip (10) is connected another strip (16) called herein an anchor strap (16) which has at it's distal end an anchor (18). All stitching on the remote control holder is denoted by numeral (20). A remote control rest (30) and (32) is shown in the middle part of the holder to hold a remote control (not shown). The rest has side wall braces (42). A remote control holder strap (28) which is preferably made of elastic allows for stretching and a remote fits underneath to hold it in place, this is described in further detail later on in this description. The front part of the remote control rest is preferably higher than the matching rear end.

Figure 2:
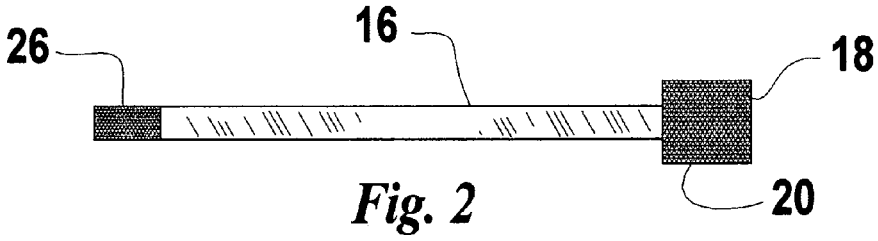
FIG. 2 shows a top view of the strap and square anchor weight of the remote control holder of the present invention
Figure 3:
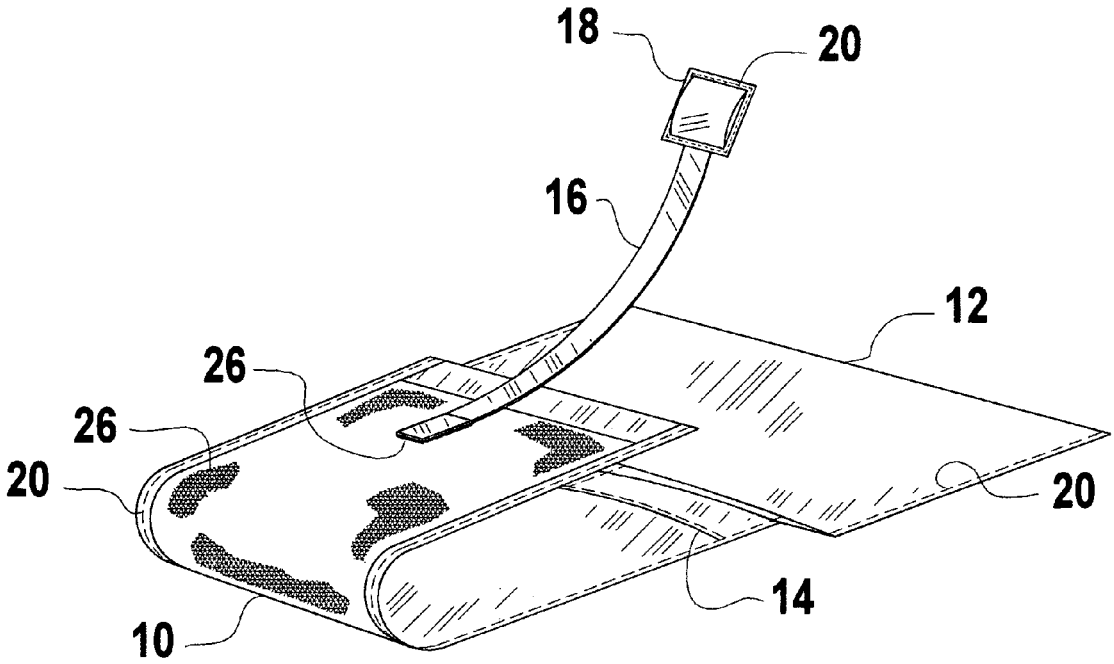
FIG. 3 shows an isometric view of the remote control holder of the present invention and it's attaching method

FIG. 2 shows the anchor strap/anchor section of the device. This figure shows clearly the fastening section (26) which allows different positioning of the strap on the holder to allow adjustability for different size seats. FIG. 3 shows the section of the middle connection strip (10) having a fastening surface (26) which is attached to the fastening section (26) of the anchor strap (16) shown in FIG. 2. The fastening surface of both parts is of releasable form to allow adjustability as stated above.

Figure 7:
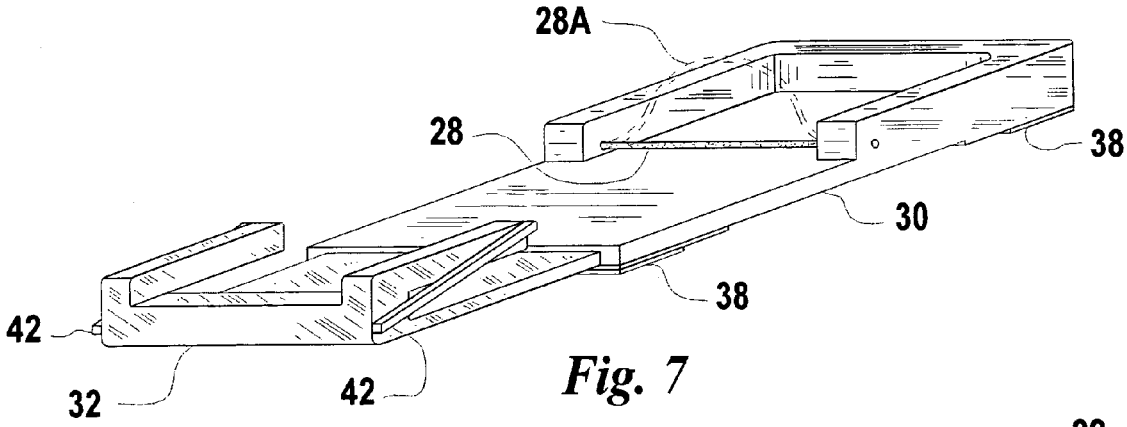
FIG. 7 shows the present invention in an extended position to accommodate larger remotes
Figure 8:
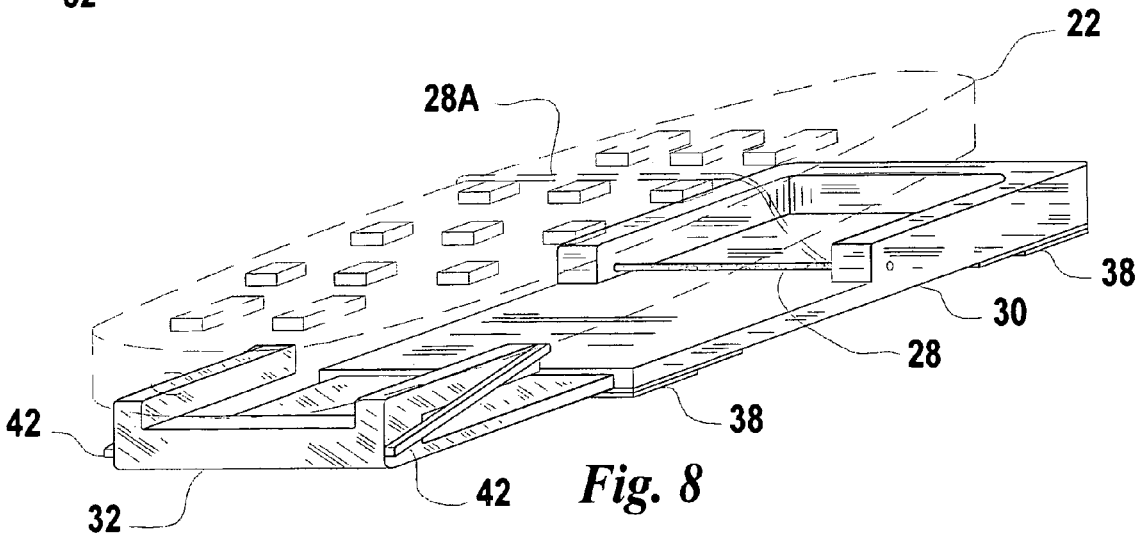
FIG. 8 shows an isometric view of a remote control juxtaposed above the remote control holder of the present invention
Figure 9:
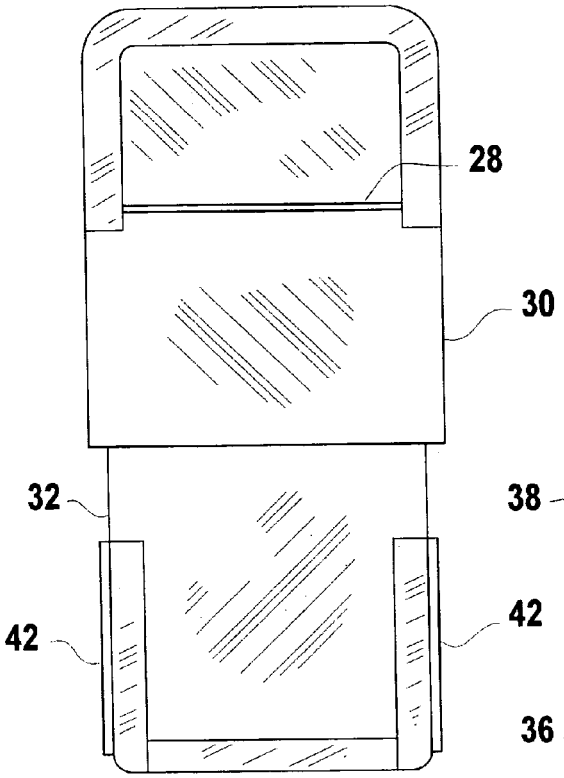
FIG. 9 shows a top view of the remote control holder of the present invention
Figure 10:
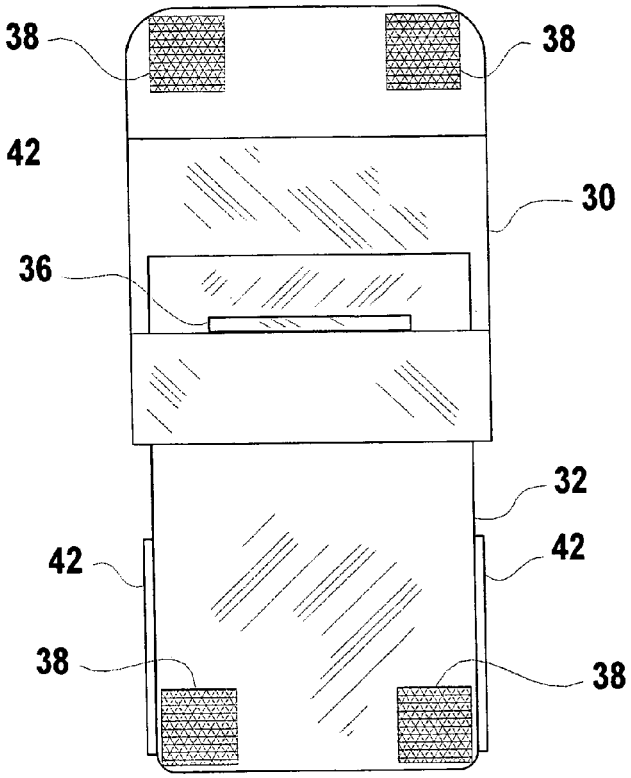
FIG. 10 shows a bottom view of the remote control holder of the present invention
Figure 11:
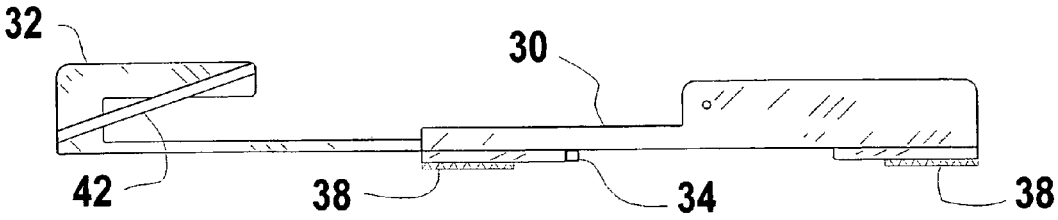
FIG. 11 shows a side view of the remote control holder of the present invention in an extended position

FIGS. 6 to 14 all show views of the remote control mounting device. The remote control rest (32) has extending from its sides sidewall braces (42). Part way along the (30) are strap entry/exit holes (40). Inserted through these is a remote control holder strap (28) which is preferably made of elastic to allow for stretching and a remote fits underneath to hold it in place. On the lower surface of the rest (30) are fastener legs (38) which allow attachment to the middle connection strip and allow adjustability for differing positioning in situ to allow for user preference. A sliding adjustment stop bar bracket in FIGS. 10 and 11 is also included on the lower surface of the rest at (34) the front and at the rear. FIG. 7 shows how the remote holder strap (28) is extended (28A) to allow a remote control to be inserted underneath it. FIG. 8 shows a remote control (22) held in place.

Figure 12:
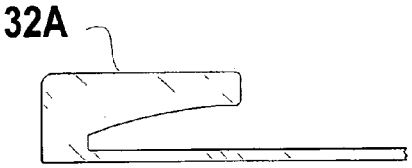
FIG. 12 shows another side view of the remote control holder of the present invention

FIGS. 9 and 10 shows top and bottom views respectively of the remote control holder of the present invention, FIG. 9 showing a view of the front end of the rest. FIG. 10 shows clearly the positioning of the fastener legs (38) which are preferably four in number and sliding adjustment bar bracket (34). FIG. 11 shows how the remote mounting device can be adjusted to an extended position by the sliding of the front end (32) out of the rear end (30) to allow mounting of larger remote controls. FIG. 12 shows a side view of a side support wall (32A) which can replace the side wall brace (42) at the front of the mounting device. The side wall brace (42) is angled internally whereas the support wall (32A) may have a rounded "U" shape.

Figure 13:
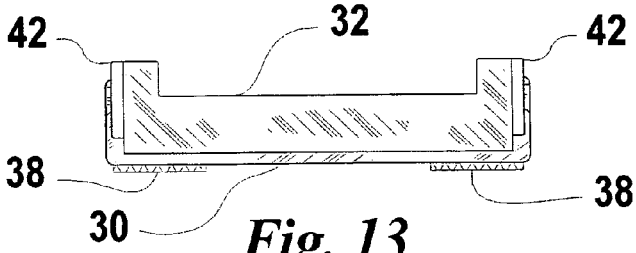
FIG. 13 shows a front-end view of the remote control holder of the present invention
Figure 14:
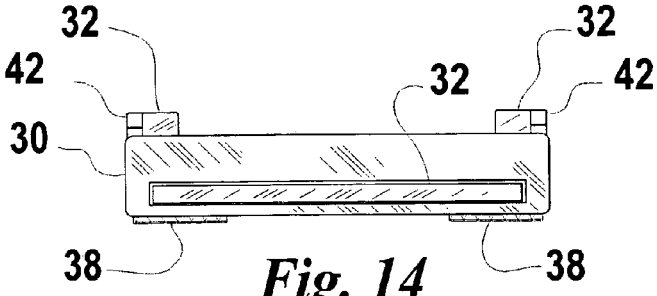
FIG. 14 shows a back end view of the remote control holder of the present invention For purposes of clarity and brevity, like elements and components will bear the same designations and numbering throughout the figures.

FIGS. 13 and 14 show a front-end view of the present invention and a rear end view of the present invention respectively. All reference numerals are consistent with those used above and will not be restated.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

The foregoing detailed description is to be clearly understood as given by way of illustration and example only, the spirit and scope of this invention being limited solely by the appended claims.

I claim:

1. A remote control holder for use on an arm of a piece of furniture comprising a panel having a top, a bottom and two sides that holds magazines, books, snacks and the like via an opening in the top of the panel, a connection strip attached to the panel along its top edge onto which is attached a remote control rest to hold a remote control in a position when in use and does not require a user to hold the remote control whilst pressing buttons on the remote control, an anchor strap attached to the opposite end of the connection strip from the panel at a first end of the anchor strap and an anchor at a second distal end of the anchor strap which is adapted to hold the remote control holder in place on the arm of the furniture, said anchor strap has a fastening section at said first end which allows for different positioning of the strap on the connection strip to allow for adjustability for different size arms on the furniture.

2. A remote control holder according to claim 1 wherein at least one remote control pouch is provided on the connection strip to hold additional remote controls.

3. A remote control holder according to claim 1 wherein the remote control rest has side braces to hold a remote control in place.

4. A remote control holder according to claim 3 wherein the remote control rest has an elastic strap extending between the side braces to hold a remote control in place.

5. A remote control holder according to claim 1 wherein the anchor is preferably weighted with sand or other suitable weighting material and is adapted to go under a cushion on a piece of furniture in use that a user sits on to provide stability on an arm of the chair.

6. A remote control holder according to claim 1 in which the anchor has a fastening material on one face to attach to a piece or furniture in use to provide additional hold.

7. A remote control holder according to claim 1 in which the connection strip has a fastening surface which can be attached to the fastening section of the anchor strap.

8. A remote control holder according to claim 1 in which the fastening surface is of releasable form to allow adjustability.

9. A remote control holder according to claim 1 wherein the lower surface of the remote control rest has securing means which allow attachment to the connection strip and allow adjustability for differing positioning to allow for user preference.

10. A remote control holder according to claim 1 wherein sliding adjustment brackets are attached on the lower surface of the remote control rest to allow for adjustability of the remote control rest to accommodate different size remote controls.

* * * * *